United States Patent [19]

Stewart

[11] Patent Number: 4,680,909

[45] Date of Patent: Jul. 21, 1987

[54] ROOFING SYSTEM

[75] Inventor: Victor M. Stewart, Redmond, Wash.

[73] Assignee: Industrial Research Development, Inc., Redmond, Wash.

[21] Appl. No.: 649,309

[22] Filed: Sep. 11, 1984

[51] Int. Cl.[4] ..... E04B 7/00; E04C 1/40; E04D 1/00

[52] U.S. Cl. ..... 52/409; 52/461; 52/540; 52/574; 52/748

[58] Field of Search ..... 52/409, 470, 574, 465, 52/461, 462, 540, 748, 592, 641, 640, 410, 408

[56] References Cited

U.S. PATENT DOCUMENTS

| | | | |
|---|---|---|---|
| 1,710,413 | 4/1929 | Evans | 52/461 X |
| 2,336,191 | 12/1943 | Rose | 52/461 |
| 3,468,086 | 9/1969 | Warner | 52/540 X |
| 3,505,770 | 4/1970 | Bennett | 52/408 X |
| 3,525,661 | 8/1970 | Jackson | 52/574 X |
| 3,914,916 | 10/1975 | Simpson et al. | 52/748 |
| 4,078,349 | 3/1978 | Gantner | 52/409 |
| 4,162,597 | 7/1979 | Kelly | 52/592 X |
| 4,274,238 | 6/1981 | O'Riordain | 52/409 X |
| 4,368,604 | 1/1983 | Spielau et al. | 52/592 X |

FOREIGN PATENT DOCUMENTS

| | | | |
|---|---|---|---|
| 56105 | 7/1982 | European Pat. Off. | 52/461 |
| 2737614 | 3/1979 | Fed. Rep. of Germany | 52/409 |
| 717032 | 10/1954 | United Kingdom | 52/592 |

*Primary Examiner*—Stanley N. Gilreath
*Assistant Examiner*—Lynn M. Sohacki
*Attorney, Agent, or Firm*—Berman, Aisenberg & Platt

[57] ABSTRACT

A roofing system comprises a plurality of prefabricated panels and spacers. The panels comprise a base member and a lamina covering. The lamina extends from one end of the panel to provide an overlap with an adjacent panel and is spaced inwardly of side edges of the base to form exposed parts. In accordance with the method, a row of prefabricated panels is secured to a roof, and a row of spacers is then applied adjacent the row of panels. A second row of panels is then placed adjacent the row of spacers, and a closure is placed over the spacers and onto a portion of the two rows of panels. The panels, lamina and closure are of readily available, standard sized materials.

2 Claims, 6 Drawing Figures

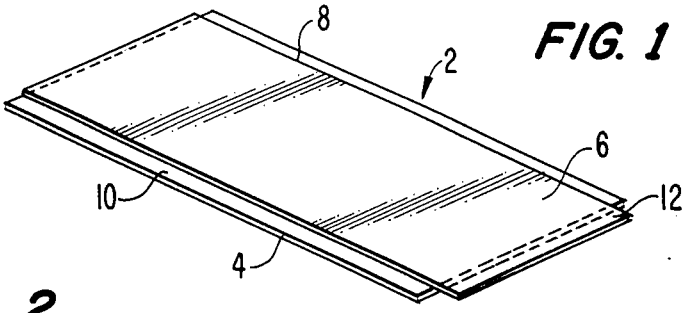
FIG. 1
FIG. 2
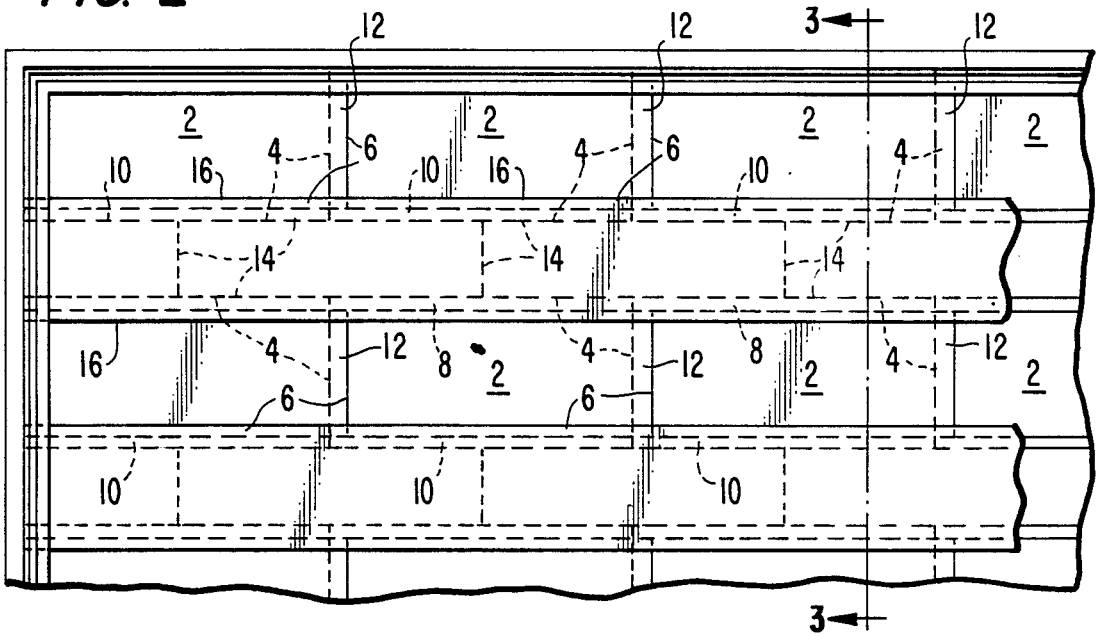
FIG. 3
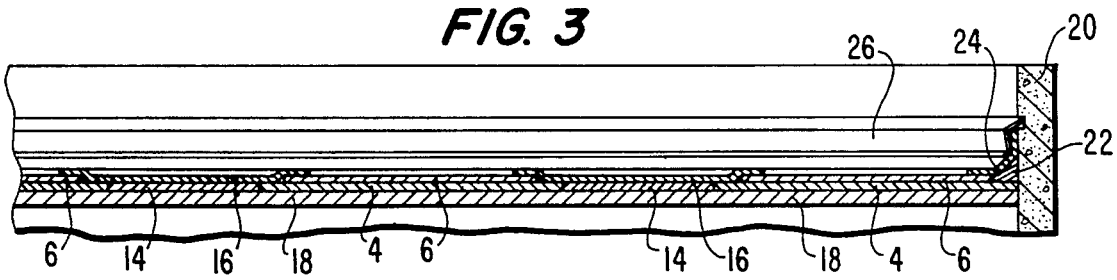
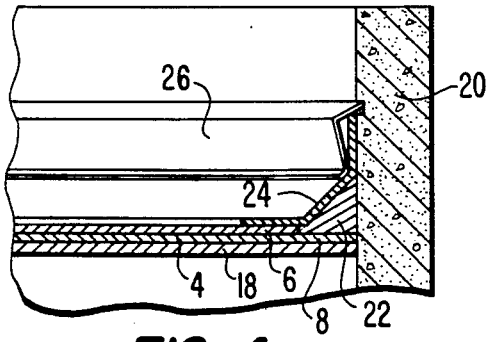
FIG. 4
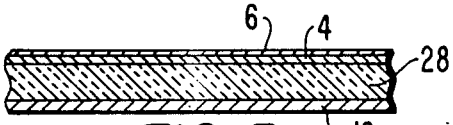
FIG. 5
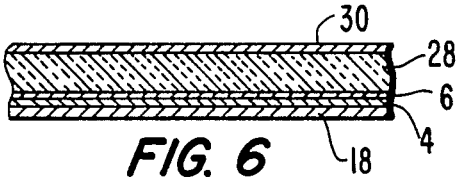
FIG. 6

ROOFING SYSTEM

TECHNICAL FIELD

This invention relates to the art of roofing, particularly the application of protective outer surfaces on roofs.

BACKGROUND ART

In a known technique for applying an outer covering to a roof, a plurality of layers of tarpaper is applied to the roof by coating the roof and each layer with hot tar. A first layer of tarpaper is placed on top of a layer of hot tar, and subsequent layers of tarpaper are secured by additional applications of tar to a lower layer of tarpaper. A layer of crushed rock is applied as the outermost layer of the roof.

In other techniques, layers of overlapping sheets are applied to a roof. Many of the sheets are prefabricated to facilitate installation.

U.S. Pat. No. 2,336,191 (Rose) shows a prefabricated panel which comprises an elongate element having reinforcing strips along its parallel, opposed side edges. A roof is covered by placing a plurality of these panels adjacent each other and securing the edges together by covering the reinforcing strips with a cap which is nailed to the prefabricated panel and to the roof.

U.S. Pat. No. 3,468,068 (Warner) shows a prefabricated roofing system wherein a panel has a notched edge which cooperates with a notched edge on an adjacent panel. A covering sheet is secured to an upper surface of each panel and includes flaps which extend beyond one side and beyond one end for overlapping onto adjacent panels.

U.S. Pat. No. 3,505,770 (Bennett) shows a construction technique wherein prefabricated panels are covered with a first lamina such that bands along the margin of the panels are not covered by the lamina. After the panels are secured to the roof by nailing through the marginal bands, flaps of the lamina are pulled over the marginal bands to provide a waterproof covering.

U.S, Pat. Nos. 3,914,916 (Simpson, et al.) and 4,078,351 (Simpson) show panels for application to a roof wherein lamina covering the panels overlap to provide a weather-proof covering.

U.S. Pat. No. 4,162,597 (Kelly) shows a plurality of interlocking panels. A square pad is provided at each corner of the interlocking panels to secure them to the roof, and a rubber or plastic sheet is laid over the entire structure.

SUMMARY OF THE INVENTION

The techniques employed in the prior art are expensive in that they require panels uniquely constructed for the particular purpose and require a significant length of time to properly install the panels. In areas of the country where there is a significant amount of rain, it is imperative that a roofing system be capable of complete installation in a minimum length of time, and this is not possible with prior systems. Furthermore, it is preferable that the materials required be easily obtained or constructed from materials of standard size to thereby reduce the cost.

In accordance with the invention, a method of applying a protective covering to a roof comprises the use of prefabricated panels having a protective covering thereon. The covering is applied such that an uncovered band remains along each side of the panel, and a lap extends from one end of the panel. When the panels are laid end-to-end, the flap overlaps onto an adjacent panel and is easily secured to seal the junction by heating the flap and pressing it onto the covering of the adjacent panel. Then, a spacer is placed along the sides of the panels, and other panels are placed adjacent the spacer. The width of the spacer is such that a standard-width covering may then be applied to cover the spacer and to overlap onto the panels on either side of the spacer. Known equipment may be used to apply this covering very quickly.

Thus, a roof covering will be applied very quickly by simply securing the prefabricated panels and the spacers to the roof and then covering the spacers with easily-available material in a known manner. Furthermore, the panels are of standard size and the covering on the panels is of standard size resulting in less expensive panels.

An object of this invention is to provide a method for applying a protective covering to a roof.

A further object of the invention is to provide a unique prefabricated panel for easy installation on a roof.

A still further object of this invention is to provide a method for applying a protective covering to a roof wherein a plurality of standard-sized panels are secured to a roof, and a standard-sized closure covers the joints between adjacent panels.

Yet another object of this invention is to provide a technique for covering a roof wherein a plurality of standard-sized panels is spaced from a second plurality of standard-sized panels by a spacer and wherein the spacer is covered by a standard-sized closure lamina.

BRIEF DESCRIPTION OF THE INVENTION

FIG. 1 is a perspective view of a prefabricated panel in accordance with the invention.

FIG. 2 is a top view of a portion of a roof covered in accordance with the invention.

FIG. 3 is a cross section taken along line 3—3 of FIG. 2.

FIG. 4 is a partial, enlarged view of the right-hand portion of FIG. 3.

FIG. 5 is a cross section of the roof showing how insulation may be used with the invention.

FIG. 6 is a cross section of a roof showing another manner in which insulation may be used with the invention.

DETAILED DESCRIPTION

FIG. 1 shows a prefabricated panel 2 in accordance with one aspect of the invention. A base member 4 is covered by a lamina 6. Preferably, the width of the lamina 6 is less than that of the base member 4 to leave exposed edges 8 and 10 of the base member 4. The length of the lamina 6 is preferably longer than that of the base member 4 to provide a flap 12 which extends beyond one end of the base member 4.

The base member 4 is preferably ½ inch fiberboard which is coated on each side, and the lamina is preferably a modified bitumen having a thickness of about 150 mils. The base member is preferably a 4×8-foot standard-sized panel, and the lamina has the standard width of 39 inches and is thus easily available.

FIG. 2 shows how the panels are to be placed on a roof in accordance with the invention. A plurality of panels 2 are placed end-to-end, and flaps 12 are overlapped and secured to adjacent panels. Then, spacers 14 are placed adjacent the row of prefabricated panels 2. A subsequent row of prefabricated panels 2 is then placed adjacent the spacers 14 and the ends are secured by overlapping flaps 12 as in the first row.

The panels 2 are preferably secured to the roof by strip-mopping adhesive onto the roof sheathing, placing the panel onto the adhesive, and securing the panel to the sheathing by driving fasteners, such as nails, through the exposed edge portions 8 and 10 and into the sheathing. Spacers 14 are secured to the sheathing by placing them on the adhesive and driving fasteners through a center portion of the spacers and into the sheathing.

After two rows of panels and an intervening row of spacers has been applied to the roof, a closure 16 is placed over the row of spacers 14. The closure extends across exposed edges 8 and 10 and onto portions of the lamina 6. The closure 16 is preferably a continuous strip and is applied from a roll with a known apparatus (not shown) which provides heating devices such that the closure 16 is almost immediately sealed to the spacer 14 and adjacent prefabricated panels 2 as the applying apparatus is moved across the roof. The closure is preferably a modified bitumen having a width of 39 inches which is easily available from construction supply houses.

The prefabricated panels are preferably shipped to a job in the condition shown in FIG. 1. The spacers are similarly supplied, and the closure 16 is supplied as the known roll of roofing material. The base member 4 is preferably 4×8 feet in exterior dimensions. The spacers are preferably 2×8 feet in exterior dimensions and are preferably formed by simply cutting a 4×8 sheet lengthwise into two pieces. The lamina 6 is 39 inches wide and is preferably of the same material as the closure 16. It will be appreciated that the materials employed by the invention are all easily available and do not require special manufacturing.

FIG. 3 shows a cross section taken along line 3—3 of FIG. 2. Roof sheathing 18 is secured to a building in a known manner, and a parapet wall 20 extends upwardly along an outer wall of a building and beyond the sheathing. A cant strip 22 is placed at the edge of the roof between a panel and the parapet wall, and a flashing 24 covers the cant strip 22 and a portion of lamina 6. A counterflashing 26, which may be of aluminum, or the like, is placed over the flashing 24 and engages the parapet wall 20. This allows the edges to be sealed. FIG. 4 shows this structure in enlarged scale.

FIGS. 5 and 6 illustrate how insulation may be used with the invention. In FIG. 5 a layer of insulation 28 is secured to sheathing 18, and the panel 2 is then secured to the roof above the insulation 28.

In FIG. 6, the prefabricated panel 6 is secured directly to the sheathing 18, and the insulation 28 is placed on top of the panels. An outer coating 30 is then applied to an upper surface of the insulation 28.

In a preferred method of applying the prefabricated panels and spacers, an existing roof is cleaned of all loose material and the surface is strip-mopped with adhesive. Then, beginning at an edge of the roof, prefabricated units 2 are applied to the adhesive. The panels are fastened by driving nails through edges 8 and 10, and the flaps 12 are heat-sealed to adjacent panels. Spacers are then applied abutting the prefabricated panels, and a second row of prefabricated panels is applied adjacent the spacers. The closure is then applied over the spacer, using a known apparatus which heat-seals the closure to the spacer and to the lamina on adjacent panels. The cant is then applied and the flashings are applied over the cant and onto the parapet wall. An exterior coating is then applied over the entire surface by mopping or rolling.

The inventive roofing may be applied very quickly and has been found useful in those areas of the country where it is necessary to complete a job in a short period of time. Such a system is also less expensive than prior systems because of the reduced installation time. Furthermore, all of the elements are made of easily-available materials which results in reduced cost. Modifications of the invention within the scope of the appended claims will be apparent to those of skill in the art.

What is claimed is:

1. Apparatus for installation on a roof comprising a plurality of panels, each panel comprising base member means and covering means wherein said covering means is a sheet secured to an upper surface of said base member means and having one end substantially flush with one end of said base member means, two sides, each of which is spaced inwardly from a respective side of said base member means, said covering means leaving uncovered an edge strip on each side of said base member means, and a second end which extends beyond a second end of said base member means, and further comprising spacer means for being secured to a roof between adjacent prefabricated panels and closure means for covering said spacer means and exposed side portions of said adjacent prefabricated panels.

2. Apparatus according to claim 1 wherein each of said covering means, spacer means, and said base member means is rectangular, and wherein said closure means is a sheet having a width of substantially thirty-nine inches.

* * * * *